US007637848B1

(12) United States Patent
Chang

(10) Patent No.: US 7,637,848 B1
(45) Date of Patent: Dec. 29, 2009

(54) EXERCISE APPARATUS FOR SIMULATING STEPPING OR SKIING MOTIONS

(75) Inventor: Shao-Tsu Chang, Taoyuan Hsien (TW)

(73) Assignee: Solid Focus Industrial Co., Ltd., Taoyuan Hsien (TW)

( * ) Notice: Subject to any disclaimer, the term of this patent is extended or adjusted under 35 U.S.C. 154(b) by 0 days.

(21) Appl. No.: 12/458,744

(22) Filed: Jul. 22, 2009

(30) Foreign Application Priority Data

Dec. 16, 2008 (TW) ..... 97222530 U

(51) Int. Cl.
*A63B 22/00* (2006.01)
*A63B 69/18* (2006.01)
*A63B 22/04* (2006.01)

(52) U.S. Cl. ..... 482/51; 482/52; 482/70

(58) Field of Classification Search ..... 482/51–53, 482/57, 70, 79–80
See application file for complete search history.

(56) References Cited

U.S. PATENT DOCUMENTS 4,509,742 A * 4/1985 Cones ..... 482/58
5,195,935 A * 3/1993 Fencel ..... 482/70
5,226,866 A * 7/1993 Engel et al. ..... 482/70
5,536,225 A * 7/1996 Neuberg et al. ..... 482/71
6,036,622 A * 3/2000 Gordon ..... 482/51
6,071,215 A * 6/2000 Raffo et al. ..... 482/57
6,368,252 B1 * 4/2002 Stearns ..... 482/52
6,468,184 B1 * 10/2002 Lee ..... 482/52
6,485,395 B1 * 11/2002 Stearns et al. ..... 482/57
6,569,061 B2 * 5/2003 Stearns et al. ..... 482/52
6,835,166 B1 * 12/2004 Stearns et al. ..... 482/52
6,905,441 B2 * 6/2005 Anderson et al. ..... 482/52
7,014,597 B2 * 3/2006 Tsai ..... 482/52
7,226,392 B2 * 6/2007 Hong ..... 482/52
7,479,093 B1 * 1/2009 Immordino et al. ..... 482/52
7,507,186 B2 * 3/2009 Stearns et al. ..... 482/52

* cited by examiner

*Primary Examiner*—Steve R Crow
(74) *Attorney, Agent, or Firm*—Bacon & Thomas, PLLC

(57) ABSTRACT

An exercise apparatus for simulating stepping or skiing motions includes a support frame, a wheel set, two link rod devices, two slide boards and two pedals. The wheel set is mounted onto the support frame. The two link rods are installed on corresponding sides of the support frame, such that the link rods can be driven by the wheel set. The two slide boards are installed on corresponding sides of the support frame. A hanging hook of each slide board is latched onto the erect stand. At least one roller is installed at bottom of the slide board to slide the slide board on the bottom frame. A pin is provided for securing the two slide boards onto the two second link rods. Users can switch the orbit of the pedals by changing the fixing position of the slide boards to select a stepping or skiing exercise.

12 Claims, 5 Drawing Sheets

EXERCISE APPARATUS FOR SIMULATING STEPPING OR SKIING MOTIONS

FIELD OF THE INVENTION

The present invention generally relates to exercise machines, and more particularly to a machine that integrates a stepping mechanism and a skiing mechanism, such that a user can switch the exercise mechanism for a stepping or skiing exercise by simply changing the position of a slide board.

BACKGROUND OF THE INVENTION

With the advance of medical knowledge and the emphasis of health concepts, we understand that appropriate exercises not only relax both of our mind and body effectively, but also allow us to have a clear mind. Therefore, more and more people do exercises (including jogging and playing balls, etc) at countryside or in a park nearby after work or in holidays. However, people nowadays become busier at work and usually get off from work later in the evening. Based on a safety factor, people are usually reluctant to go out at night for exercise, and they rather work out in a gymnasium instead, so that they can do exercises in a safer place at nighttime.

Most gymnasiums adopt a membership system that requires their members to pay an annual fee. In other words, a member pays an annual fee to work out in the gym for an unlimited number of times in that year. As to the busy working people, it will reduce their willingness to go to a gymnasium for exercises after a day of busy work, if they have to go home to change clothing and drive to the gymnasium back and forth. Even though people have spent much money for the membership, the expected effect cannot be achieved efficiently. In addition, people generally choose one or two exercise machines for their exercises as needed, and will not use all exercise machines in the gymnasium, although the gymnasium provides various different fitness equipments and exercise machines. Therefore, exercisers tend to buy their own exercise apparatus and do exercise at home instead of going to other places for the exercise, and have a better management of their exercise time. What is more, people can change clothing before and after doing exercises easily, which provides tremendous convenience to the exercisers. Therefore, manufacturers keep introducing various different exercise apparatuses to the market and provide many choices of home exercise apparatuses for users.

However, most traditional exercise apparatuses come with a single function, so that if a user purchases a stepping machine, the user can use the stepping machine for a stepping exercise only, and the user may get tired of such monotonous exercise easily. If the user wants to avoid the monotonous exercise or train muscles of other parts of the user's body, then the user has to buy another exercise apparatus (such as a skiing machine) to achieve the intended purpose. In other words, the user has to spend more money to buy different exercise apparatuses. Since an exercise apparatus comes with a specific volume and requires a certain space for separating the exercise apparatuses to avoid a collision or an interference with each other, therefore a larger indoor space is required for placing these exercise apparatuses. Obviously, the traditional exercise apparatuses with a single function not only waste spatial resources, but also incur additional expenses.

In summation of the description above, the traditional exercise apparatuses are inconvenient to users, and it become an important subject for related designers and manufacturers to provide an exercise apparatus capable of providing two types of exercises to give more fun to the exercise and reduce the required space of placing the exercise apparatuses.

SUMMARY OF THE INVENTION

In view of the shortcomings of the conventional exercise apparatus with a single function, the inventor of the present invention based on years of experience in the related industry to conduct extensive researches and experiments, and finally developed an exercise apparatus for simulating stepping or skiing motions in accordance with the present invention to overcome the shortcomings of the prior art.

Therefore, it is a primary objective of the present invention to provide an exercise apparatus for simulating stepping or skiing motions, such that a user can select a stepping or skiing exercise. The exercise apparatus comprises a support frame composed of an erect stand and a bottom frame, wherein the bottom frame is disposed transversally on a floor, and the erect stand is connected to bottom frame and extended upward, and a wheel set is mounted onto the support frame, and the two link rod devices are installed on two corresponding sides of the support frame, and composed of a first link rod and a second link rod, and ends of the two first link rods are fixed to both ends of a wheel axle of the wheel set, so that the two first link rods can be driven by the wheel set and rotated by using the wheel axle as the center, and other ends of the two first link rods are pivotally coupled to ends of the two second link rods, and other ends of the two second link rods are extended parallel to both sides of the erect stand. In addition, the two slide boards are installed onto both corresponding sides of the support frame, and a hanging hook is disposed at an end of each slide board and latched onto a transverse rod of the erect stand, and at least one roller is installed at the bottom of another end of each of the two slide boards, so that the two slide boards can be slid on the bottom frame, and the two slide boards are secured onto the two second link rods by a pin. Further, a plurality of rollers are installed at the bottom of the two pedals and slid on each slide board, and a connecting plate is extended downward from an end of each of the two pedals, and at least one position limiting roller is installed at the bottom of the connecting plate. The connecting plate and the position limiting roller fix the pedal onto the slide board, and an end of the connecting plate is pivotally coupled to another end of each second link rod and driven by each second link rod. Therefore, a user can switch the moving orbit of the two pedals by simply changing the fixing position of the two slide boards of the exercise apparatus in order to select a stepping or skiing exercise according to the user's requirement and preference when the user is standing on the two pedals.

Another objective of the present invention is to provide an exercise apparatus, further comprising two driving devices installed on two corresponding sides of the two driving devices respectively, and each driving device includes a handle and a driving rod. The two driving rods are pivotally coupled onto the erect stand, and the two handles are installed to ends of the two driving rods respectively, and other ends of the two driving rods are pivotally coupled to the two pedals or the two connecting plates, such that when a user stands on the two pedals with the user's legs, the user can hold and push the two handles by both hands. With the forces of the legs and hands, the mechanism of the exercise apparatus is driven, so that the user can do the stepping or skiing exercise in a more effort-saving manner.

DETAILED DESCRIPTION OF THE PREFERRED EMBODIMENTS

Figure 1:
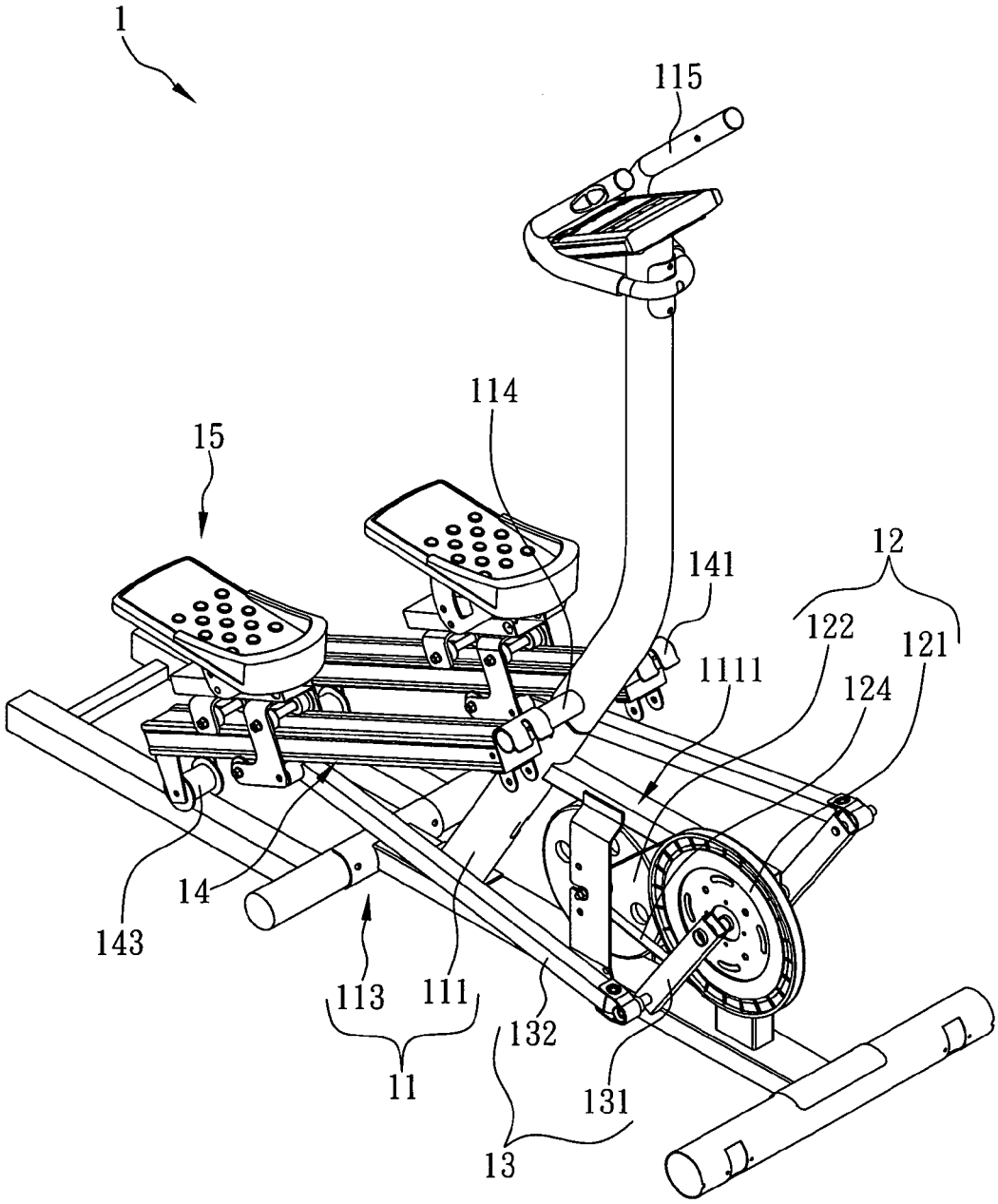
FIG. 1 is a schematic view of a preferred embodiment of the present invention.
Figure 2:
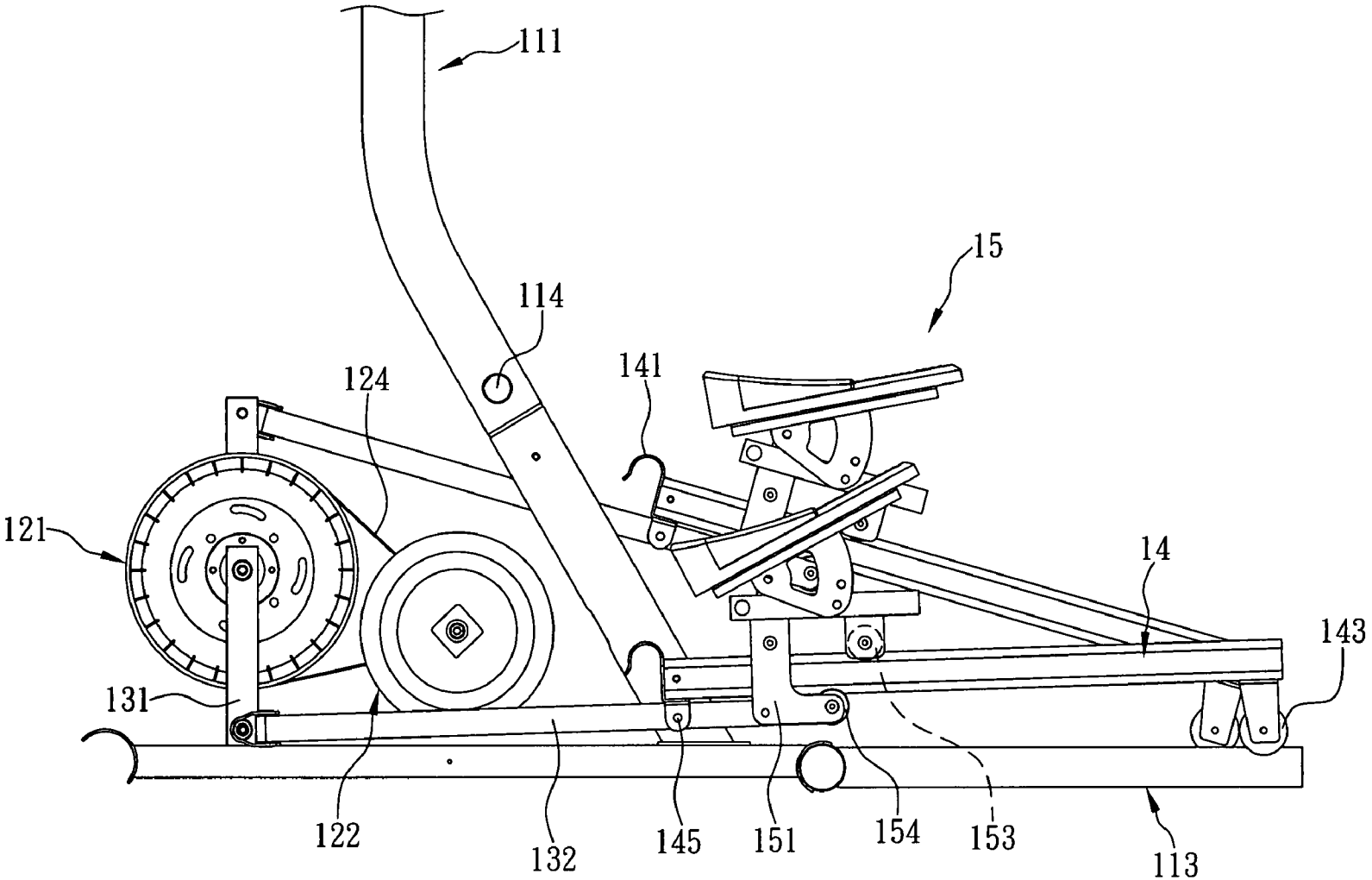
FIG. 2 is a schematic view of a slide board and a second link rod connected with each other in accordance with the present invention.

The present invention provides an exercise apparatus for simulating stepping or skiing motions, such that an exerciser can to two kinds of exercises (such as stepping exercise and skiing exercise) on the same exercise apparatus. With reference to FIG. 1 for an exercise apparatus in accordance with a preferred embodiment of the present invention, the exercise apparatus 1 comprises: a support frame 11, a wheel set 12, two link rod devices 13, two slide boards 14 and two pedals 15, wherein the support frame 11 is composed of an erect stand 111 and a bottom frame 113 to constitute a main body of the exercise apparatus 1, and the bottom frame 113 is disposed transversally on a floor, and an end of the erect stand 111 is connected to the bottom frame 113, and another end is extended upward to constitute an inverted T-shaped form. In a practical application, the support frame is integrally formed or assembled with parts, and its shape is not limited to the form of this preferred embodiment, but an L-shape or any other shape can be adopted instead. The wheel set 12 is mounted onto the support frame 11, and the wheel set 12 of this preferred embodiment is installed by a connecting unit 1111 extended from the erect stand 111, and the wheel set 12 is composed of a first wheel 121 and a second wheel 122, wherein the second wheel 122 is a damper for providing a predetermined rotating resistance, and the two wheels 121, 122 are connected by a belt 124 and driven by each other. However, other preferred embodiments of the present invention may have a wheel set with a different configuration instead of two wheels only, and the wheel set is connected to the bottom frame instead of being connected to the erect stand only. Since the connecting relation among the link rod device 13, the slide board 14 and the pedal 15 is the same, and the only difference resides on their installing positions (which are on two corresponding sides of the support frame 11) of the support frame 11. For simplicity, the mechanism at one side is used for the description here. The link rod device 13 is composed of a first link rod 131 and a second link rod 132, and an end of the first link rod 131 is fixed to an end of a wheel axle of the first wheel 121 as shown in FIG. 2. To avoid complicated drawings, we use simplified drawings for FIGS. 2 and 3 and keep the necessary mechanisms for illustrating the operating relation among the link rod device 13, the slide board 14 and the pedal 15. When the wheel set 12 is rotated, the first link rod 131 is driven by the first wheel 121 and rotated by using the wheel axle as the center (as indicated by the arrow in FIG. 2), and another end of the first link rod 131 is pivotally coupled to an end of the second link rod 132, and another end of the second link rod 132 is extended along a side of the erect stand 111, and the second link rod 132 is parallel to another second link rod 132. It is noteworthy to point out that the user's legs are situated at different positions, when the user is walking (or stepping or skiing), such that if another end of a first link rod 131 is situated at a position proximate to the floor, then another end of another first link rod 131 will be situated at a position away from the floor to simulate the walking motion accurately.

Figure 3:
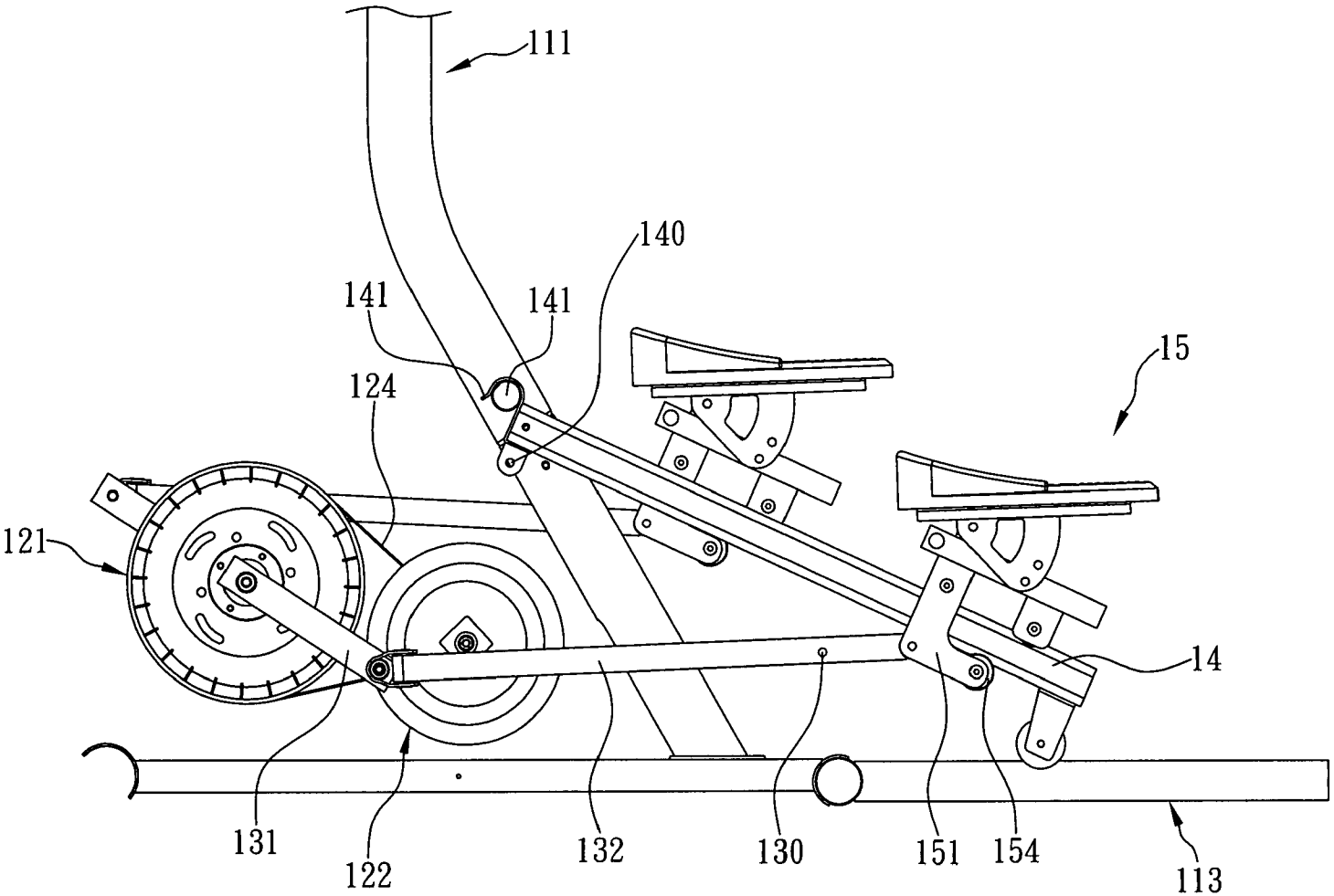
FIG. 3 is a schematic view of a slide board latched onto an erect stand in accordance with the present invention.
Figure 4:
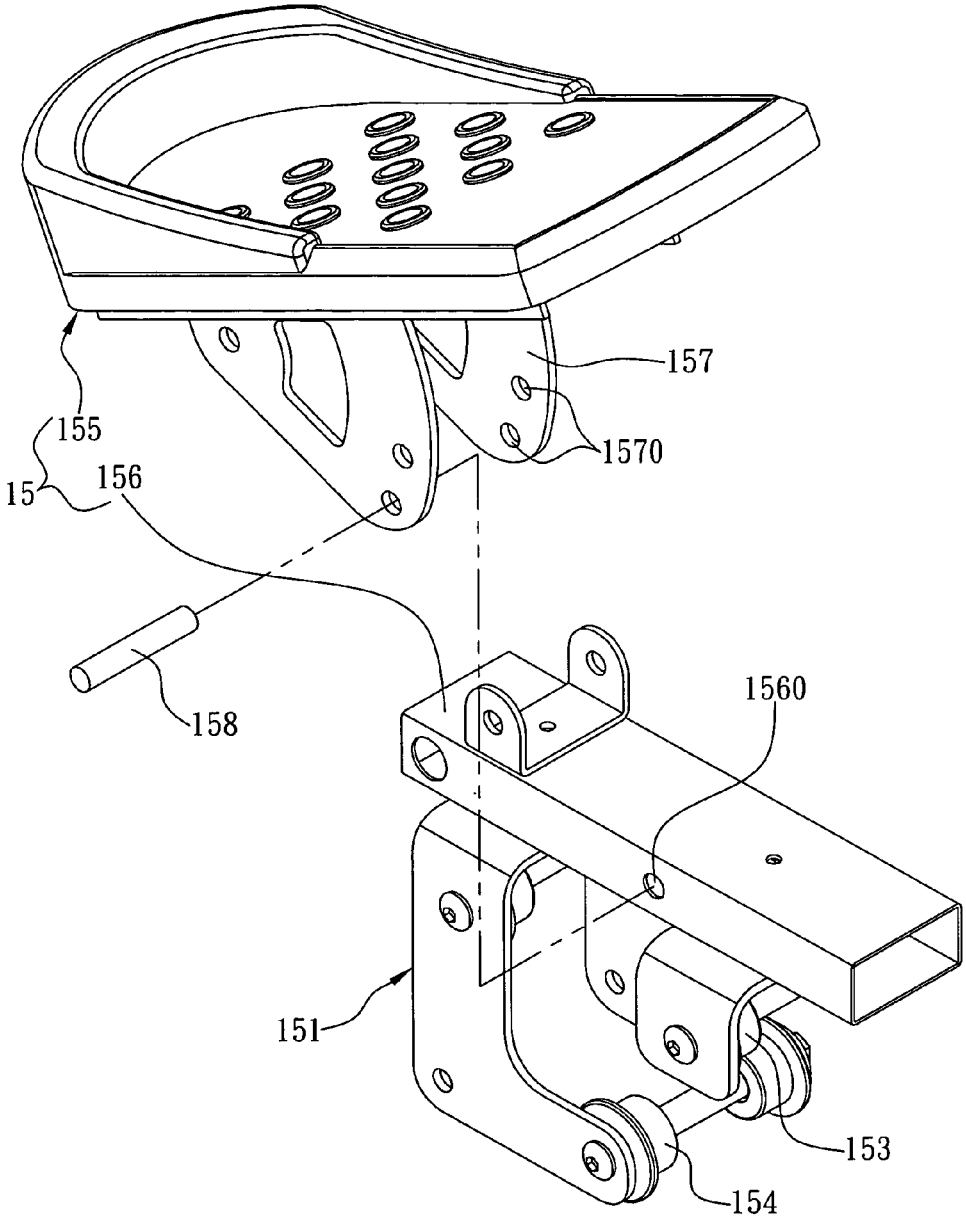
FIG. 4 is a schematic view of a pedal in accordance with the present invention.

With reference to FIG. 1, the slide board 14 includes a hanging hook 141 disposed at an end of the slide board 14 and provided for a user to latch the hanging hook 141 onto a transverse rod 114 of the erect stand 111, and at least one roller 143 installed at the bottom of another end of the slide board 14 and disposed on the bottom frame 113, such that the slide board 14 can be slid on the bottom frame 113 by the roller 143. If an end of the slide board 14 has not been latched onto the transverse rod 114 yet, an end of the slide board 14 is still abutted against the second link rod 132. Now, a first hole 140 disposed on the slide board 14 is aligned with a second hole 130 disposed on the second link rod 132 (as shown in FIG. 3) such that the slide board 14 can be secured onto the second link rod 132 by a pin 145 (as shown in FIG. 2), and the slide board 14 is driven by the second link rod 132 and slid on the bottom frame 113. If an end of the slide board 14 is latched onto the transverse rod 114, the slide board 14 is fixed, and the position of the slide board 14 will not be affected, regardless of the movement of the second link rod. In FIG. 4, the pedal 15 includes a connecting plate 151 extended downward from an end of the pedal 15, such that the pedal 15 can be positioned on the slide board 14, and at least one pedal roller 153 installed at the bottom of the pedal 15. The connecting plate 151 includes at least one position limiting roller 154, for sliding the pedal 15 and the connecting plate 151 on the slide board 14 through the rollers 153, 154. In addition, an end of the connecting plate 151 is pivotally coupled to another end of the second link rod 132, such that when the second link rod 132 is moved, the connecting plate 151 is driven to move the pedal 15 accordingly.

In FIG. 2, a user stands on the two pedals 15 with both legs, and applies forces from the legs to drive the pedals 15 to move the two link rod devices 13, the two slide boards 14 and the wheel set 12, provided that the two slide boards 14 are fixed to the two second link rods 132. Due to the inertia of the wheel set 12, the two link rod devices 13 and the two slide boards 14 are driven to move and further drive the two pedals 15 at the same time, and the positions of the two link rod devices 13 are different, so as to simulate the stepping status provided for users to do the stepping exercise. In FIG. 3, a hanging hook 141 of each of the two slide boards 14 is latched onto the transverse rod 114 of the erect stand 111, and a user stands on the two pedals 15 with both legs, and the forces of waist and legs drive the two pedals 15 to move. Since the two slide boards 14 are fixed without being driven to move, therefore the two pedals 15 can be slid on the two slide boards 14 by the rollers 153, 154 to move the two link rod devices 13 and the wheel set 12. Due to the inertia of the wheel set 12, the two link rod devices 13 are moved to drive the two pedals 15 at the same time, and the two link rod devices 13 are situated at different positions, so as to simulate the sliding status of going uphill, which is provided for a skiing exercise. When a user does the aforementioned stepping or skiing exercise, the user holds accessory handles 115 disposed at other ends of the erect stand 111 by both hands respectively (as shown in FIG. 1) to maintain the user's body balanced and prevent an injury caused by vibrations or fall-downs during the exercise process.

Figure 5:
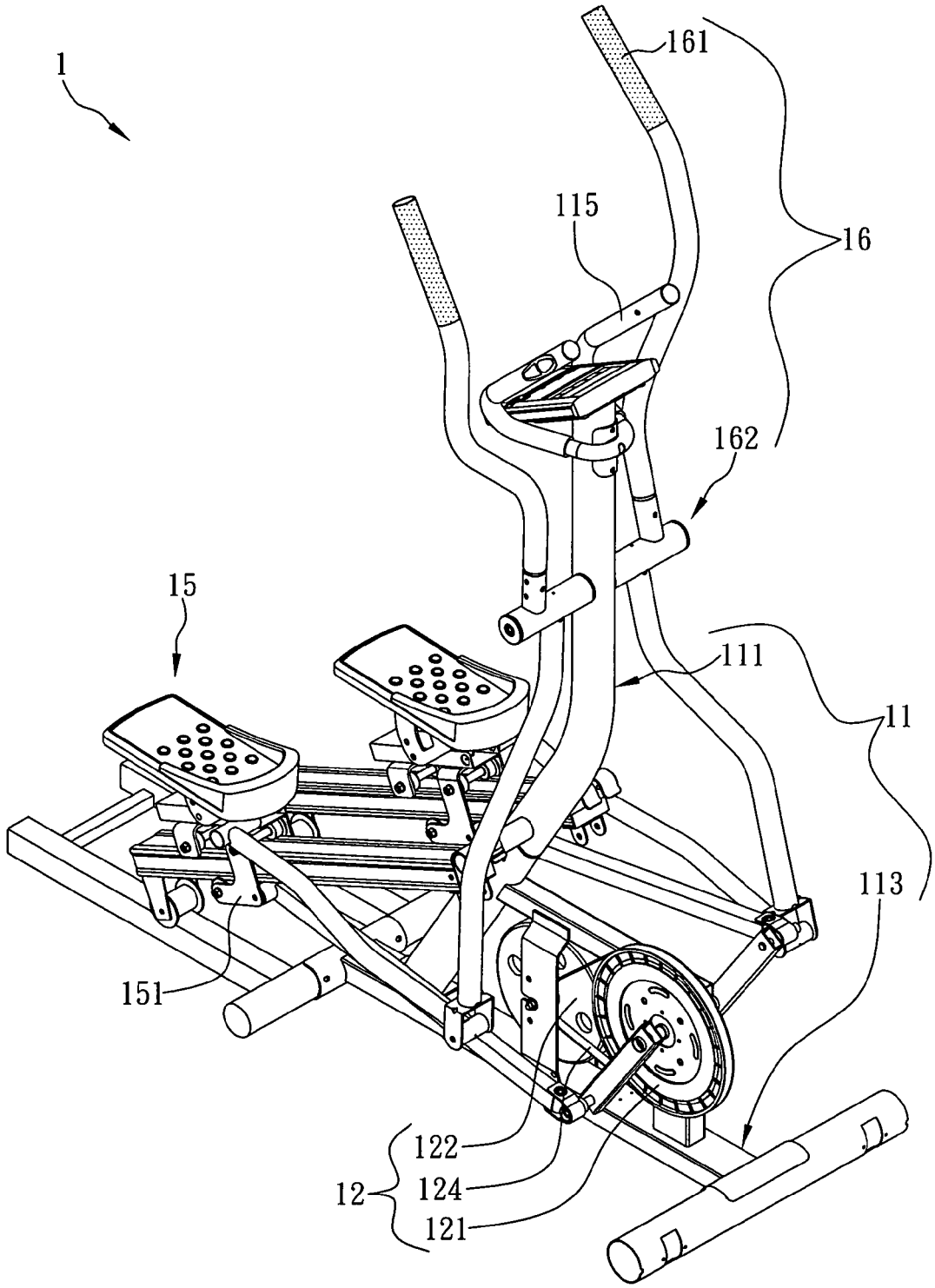
FIG. 5 is a schematic view of another preferred embodiment of the present invention.

With reference to FIG. 5 for another preferred embodiment of the present invention, the exercise apparatus 1 further comprises two driving devices 16 installed on two corresponding sides of the support frame 11 respectively, and each driving device 16 includes a handle 161 and a driving rod 162, and the driving rod 162 is pivotally coupled to a side of the erect stand 111, and the handle 161 is disposed at an end of the driving rod 162, and another end of the driving rod 162 is pivotally coupled to the two pedals 15 or the two connecting plates 151, so that when a user stands on the two pedals 15 to do exercises, the user can hold and push the two handles 161 by both hands, and forces from the hands and legs drive and move the two pedals 15, so that the user can train arm muscles and perform a stepping or skiing exercise in a power-saving manner, so as to avoid muscle strains caused by applying too-large forces, and extend the user's exercising time to achieve the effect of an aerobic exercise.

In FIG. 4, the pedal 15 in accordance with a preferred embodiment of the present invention further comprises a pedal body 155, a base 156, an adjusting plate 157 installed between the pedal body 155 and the base 156, a plurality of adjusting holes 1570 disposed on the adjusting plate 157, and a second adjusting hole 1560 disposed on the base 156, such that a user can pass an insert rod 158 through one of the first adjusting hole 1570 and the second adjusting hole 1560 to change an angle between the pedal body 155 and the base 156 and adjust the angle between the pedal body 155 and the base 156 according to the user's desired muscle training position to satisfy different user's preferences and requirements.

In summation of the description above, users can use a simple mechanical structure provided by an exercise apparatus in accordance with the present invention to change the fixing position of the two slide boards easily (such as being latched onto the transverse rod of the erect stand or secured onto the link rod device) in order to change the moving orbit for the stepping or skiing exercise of the exercise apparatus. The present invention allows users to select a stepping or skiing exercise according to their desire and preference, so that users only need to buy a set of exercise apparatus to enjoy two different kinds of exercises without requiring additional space for placing the other additional exercise apparatus, and thus the present invention gives tremendous convenience to users.

While the invention has been described by means of specific embodiments, numerous modifications and variations could be made thereto by those skilled in the art without departing from the scope and spirit of the invention set forth in the claims.

What is claimed is:

1. An exercise apparatus for simulating stepping or skiing motions, comprising:

a support frame, including an erect stand and a bottom frame, and the bottom frame being transversally disposed on a floor, and an end of the erect stand being coupled onto the bottom frame, and another end of the erect stand being extended upward;

a wheel set, mounted on the support frame;

two link rod devices, each composed of a first link rod and a second link rod, and said ends of the two first link rods being fixed to both ends of a wheel axle of the wheel set respectively, such that when the wheel set is rotated, the two first link rods can be rotated by using the wheel axle as a center, and other ends of the two first link rods pivotally coupled to said ends of the two second link rods respectively, and other ends of the two second link rods being extended parallelly along both sides of the erect stand respectively;

two slide boards, each having a hanging hook disposed at an end of the slide board and latched onto a transverse rod of the erect stand, and at least one roller installed at the bottom of another end of the slide board, such that the two slide boards can be slid on the bottom frame, and secured onto the two second link rods respectively; and two pedals, each having at least one pedal roller installed at the bottom of the pedal for sliding on each slide board, and a connecting plate extended downward from an end of each of the two pedals, and the connecting plate having at least one position limiting roller, such that the connecting plate and the position limiting roller are used for positioning the pedal on the slide board, and an end of the connecting plate being coupled to another end of each second link rod, and driven by each second link rod;

thereby, when a force is applied onto the two pedals to drive the pedals and move the two link rod devices, the two slide boards and the wheel set, a stepping motion is simulated, provided that the two slide boards are fixed to the two second link rods; and when a force is exerted onto the two pedals to drive the pedals to slide on the two slide boards and move the two link rod devices and the wheel set, a skiing motion is simulated, provided that the hanging hooks of the two slide boards are latched onto the transverse rods of the erect stand respectively.

2. The exercise apparatus of claim 1, further comprising two driving devices, each including a handle and a driving rod, and the two driving rods being pivotally coupled to two corresponding sides of the erect stand respectively, and the two handles being installed at ends of the two driving rods respectively, and other ends of the two driving rods being pivotally coupled to the two pedals or the two connecting plates respectively.

3. The exercise apparatus of claim 1, wherein each of the two pedals includes a pedal body, a base, an adjusting plate installed between the pedal body and the base, a plurality of adjusting holes disposed on the adjusting plate, and a second adjusting hole disposed on the base, and an angle between the pedal body and the base varies as a different first adjusting hole is aligned with the second adjusting hole.

4. The exercise apparatus of claim 2, wherein each of the two pedals includes a pedal body, a base, an adjusting plate installed between the pedal body and the base, a plurality of adjusting holes disposed on the adjusting plate, and a second adjusting hole disposed on the base, and an angle between the pedal body and the base varies as a different first adjusting hole is aligned with the second adjusting hole.

5. The exercise apparatus of claim 3, wherein the slide board has a first hole disposed thereon, and the second link rod has a corresponding second hole disposed thereon, and the first hole and the second hole are secured by a pin for securing the slide board onto the second link rod.

6. The exercise apparatus of claim 4, wherein the slide board has a first hole disposed thereon, and the second link rod has a corresponding second hole disposed thereon, and the first hole and the second hole are secured by a pin for securing the slide board onto the second link rod.

7. The exercise apparatus of claim 5, wherein the wheel set includes a first wheel and a second wheel, and the first wheel and the second wheel are installed with a connecting unit extended from the erect stand, and coupled with each other by a belt, and the second wheel is a damper for providing a predetermined rotating resistance, and both ends of the first wheel are coupled to the two first link rods respectively.

8. The exercise apparatus of claim 6, wherein the wheel set includes a first wheel and a second wheel, and the first wheel and the second wheel are installed with a connecting unit extended from the erect stand, and coupled with each other by a belt, and the second wheel is a damper for providing a predetermined rotating resistance, and both ends of the first wheel are coupled to the two first link rods respectively.

9. The exercise apparatus of claim 7, wherein the erect stand includes an accessory handle installed at another end of the erect stand.

10. The exercise apparatus of claim 8, wherein the erect stand includes an accessory handle installed at another end of the erect stand.

11. The exercise apparatus of claim 9, wherein the erect stand and the bottom frame are integrated into an inverted T-shape.

12. The exercise apparatus of claim 10, wherein the erect stand and the bottom frame are integrated into an inverted T-shape.

* * * * *